US008742271B2

(12) United States Patent
Zou

(10) Patent No.: US 8,742,271 B2
(45) Date of Patent: Jun. 3, 2014

(54) ELECTRIC PLUG

(71) Applicant: Zhongshan Kaper Electrical Co., Ltd, Zhongshan (CN)

(72) Inventor: Bill Zou, Zhongshan (CN)

(73) Assignee: Zhongshan Kaper Electrical Co., Ltd., Zhongshan (CN)

( * ) Notice: Subject to any disclaimer, the term of this patent is extended or adjusted under 35 U.S.C. 154(b) by 7 days.

(21) Appl. No.: 13/657,892

(22) Filed: Oct. 23, 2012

(65) Prior Publication Data

US 2013/0045628 A1 Feb. 21, 2013

Related U.S. Application Data

(63) Continuation-in-part of application No. PCT/CN2011/000588, filed on Apr. 6, 2011.

(30) Foreign Application Priority Data

Apr. 23, 2010 (CN) ..... 2010 1 0160389

(51) Int. Cl.
*H01R 13/648* (2006.01)

(52) U.S. Cl.
USPC ..... 200/51 R; 200/51.11; 200/520

(58) Field of Classification Search
USPC ..... 200/51 R, 51.11, 404, 520, 341
See application file for complete search history.

(56) References Cited

U.S. PATENT DOCUMENTS

| | | | | |
|---|---|---|---|---|
| 6,111,327 | A * | 8/2000 | Bae | 307/10.7 |
| 8,207,805 | B2 * | 6/2012 | Wild et al. | 335/207 |
| 2005/0034966 | A1 * | 2/2005 | Krebs et al. | 200/341 |
| 2006/0238933 | A1 * | 10/2006 | Huang et al. | 361/42 |
| 2008/0049949 | A1 * | 2/2008 | Snider et al. | 381/86 |
| 2010/0202623 | A1 * | 8/2010 | Snider et al. | 381/58 |
| 2011/0089006 | A1 * | 4/2011 | Wan et al. | 200/323 |
| 2013/0171847 | A1 * | 7/2013 | Huang et al. | 439/137 |
| 2013/0244462 | A1 * | 9/2013 | Zhang | 439/159 |

* cited by examiner

*Primary Examiner* — Gary Paumen
(74) *Attorney, Agent, or Firm* — Matthias Scholl P.C.; Matthias Scholl

(57) ABSTRACT

A plug including a shell and a mounting body disposed inside the shell. The mounting body is provided with a first movable contact spring and a second movable contact spring, a phase contact and a zero contact, and a button assembly. A transverse block disposed above the first movable contact spring and the second movable contact spring includes a phase terminal and a zero terminal. The button assembly includes an electric magnet disposed on the mounting body and a sliding part having a cavity. The cavity of the sliding part is provided with a reset spring. A hook is disposed in a lower part of the cavity. The transverse block is connected with a pull block. An upper part of the pull block is connected with the electric magnet. The center of the pull block includes a limiting hole for accommodating the hook.

11 Claims, 10 Drawing Sheets

ELECTRIC PLUG

CROSS-REFERENCE TO RELATED APPLICATIONS

This application is a continuation-in-part of International Patent Application No. PCT/CN2011/000588 with an international filing date of Apr. 6, 2011, designating the United States, now pending, and further claims priority benefits to Chinese Patent Application No. 201010160389.8 filed Apr. 23, 2010. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a plug.

2. Description of the Related Art

Currently, the protection for electric leakage of plugs is mainly dependent on electric components and rarely dependent on mechanical structures. However, electric components have high frequency of malfunction, which results in potential safety hazards, or even electric shock injuries. And for those plugs using mechanical structures, they have complicated structures and low stability.

SUMMARY OF THE INVENTION

In view of the above-described problems, it is one objective of the invention to provide a plug that has a simple structure and is protected from electric leakage.

To achieve the above objective, in accordance with one embodiment of the invention, there is provided a plug, comprising: a shell; a mounting body disposed inside the shell, the mounting body comprising a first movable contact spring and a second movable contact spring, and a phase contact and a zero contact in electric connection with an external power supply; a transverse block disposed above the first movable contact spring and the second movable contact spring and comprising a phase terminal and a zero terminal in electric connection with the first movable contact spring and the second movable contact spring, respectively; and a button assembly disposed in the mounting body for pressing the phase contact and the zero contact on the phase terminal and the zero terminal.

The phase terminal and the zero terminal are disconnected from the phase contact and the zero contact under elastic forces of the first movable contact spring and the second movable contact spring, respectively. The button assembly comprises an electric magnet disposed in the mounting body and a sliding part comprising a cavity. The sliding part is capable of moving upwards and downwards, and the cavity of the sliding part is provided with a reset spring. A lower part of the cavity comprises a hook. The transverse block is connected with a pull block. An upper part of the pull block is connected with the electric magnet, and a center of the pull block comprises a limiting hole for accommodating the hook.

In a class of this embodiment, the shell comprises an upper cover and a lower cover. A reset button hole is disposed on the upper cover for receiving a button cap of the button assembly. The phase contact and the zero contact are fixed on the lower cover, and the first movable contact spring and the second movable contact spring are disposed on the lower cover.

In a class of this embodiment, the transverse block is provided with a through hole. The pull block is inverted T-shaped. A lower part of the pull block is received by the through hole. The upper part of the pull block is connected with the electric magnet after protruding from the through hole.

In a class of this embodiment, the electric magnet comprises a sleeve, a moving armature, and a winding. A spring is disposed inside the sleeve. The moving armature is disposed inside the sleeve. When the winding is energized, the moving armature is attracted inwards, and the spring is pressed against an inner side of the sleeve.

In a class of this embodiment, the mounting body is further provided with a jacket comprising a guiding slot, and the sliding part is disposed on the guiding slot and is movable along the guiding slot.

In a class of this embodiment, the upper cover is further provided with a test button for energizing the electric magnet to disconnect the plug.

In a class of this embodiment, an upper end of the reset spring contacts with an inner top surface of the sliding part, and a lower end of the reset spring presses on the mounting body.

Advantages of the invention are summarized below:

1) The plug of the invention employs the transverse block having the phase terminal and the zero terminal in electric connection with the first movable contact spring and the second movable contact spring, respectively. The phase terminal and the zero terminal are disconnected from the phase contact and the zero contact under elastic forces of the first movable contact spring and the second movable contact spring, respectively.
2) With the help of the hook disposed on the button assembly, the transverse block can be pulled upwards, and the first movable contact spring and the second movable contact spring are contacted with the phase contact and the zero contact, respectively; thus, the electric connection is realized, and such a structure is simple and practicable.
3) To disconnect the plug from the power supply, the test button is pressed to energize the electric magnet, whereby disconnecting the first movable contact spring and the second movable contact spring from the phase contact and the zero contact, respectively. In such a way, the safety of the plug is improved.

BRIEF DESCRIPTION OF THE DRAWINGS

The invention is described hereinbelow with reference to the accompanying drawings, in which.

DETAILED DESCRIPTION OF THE EMBODIMENTS

To further illustrate the invention, experiments detailing a plug are described below. It should be noted that the following examples are intended to describe and not to limit the invention.

Figure 1:
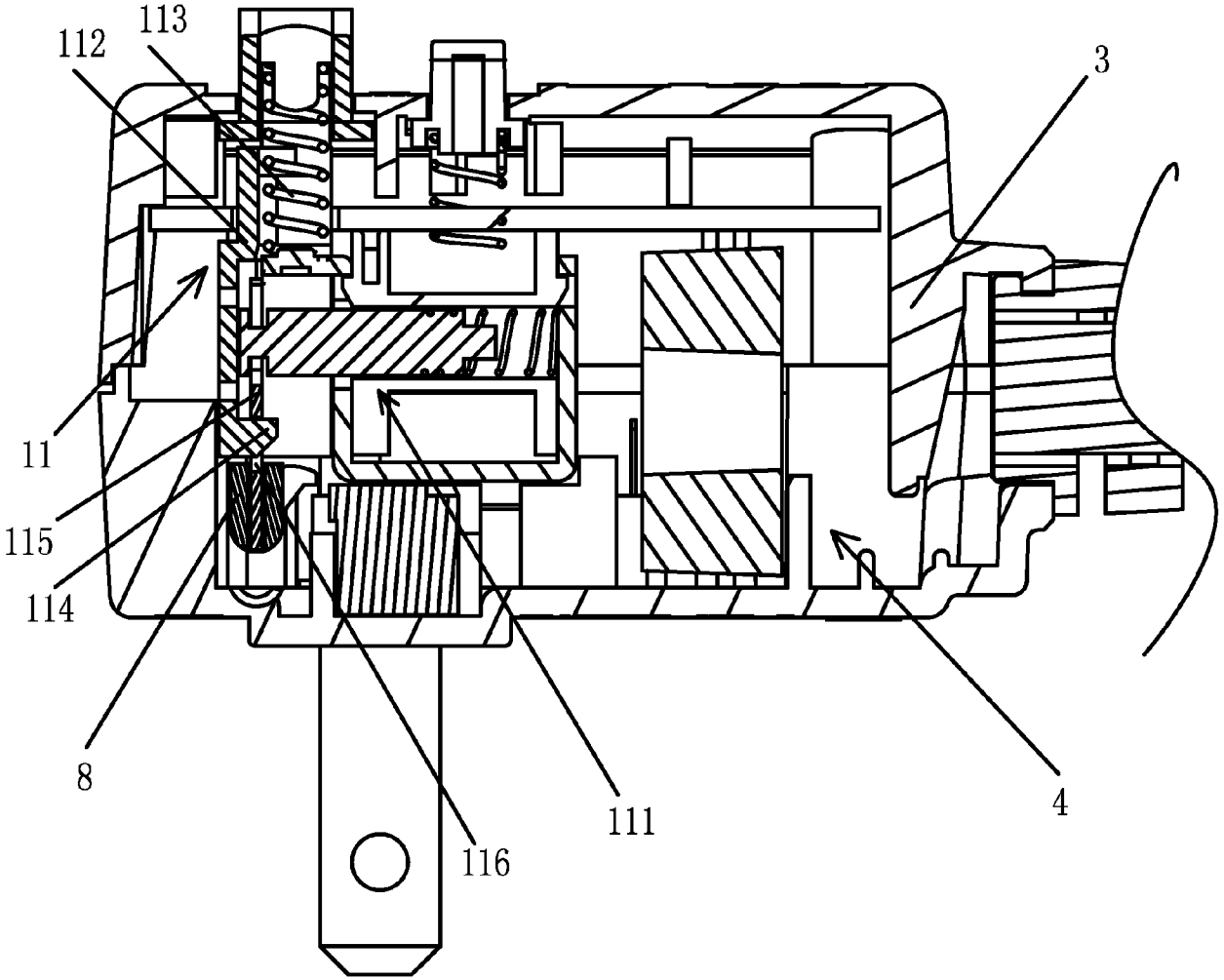
FIG. 1 is a sectional view of a plug in accordance with one embodiment of the invention.
Figure 2:
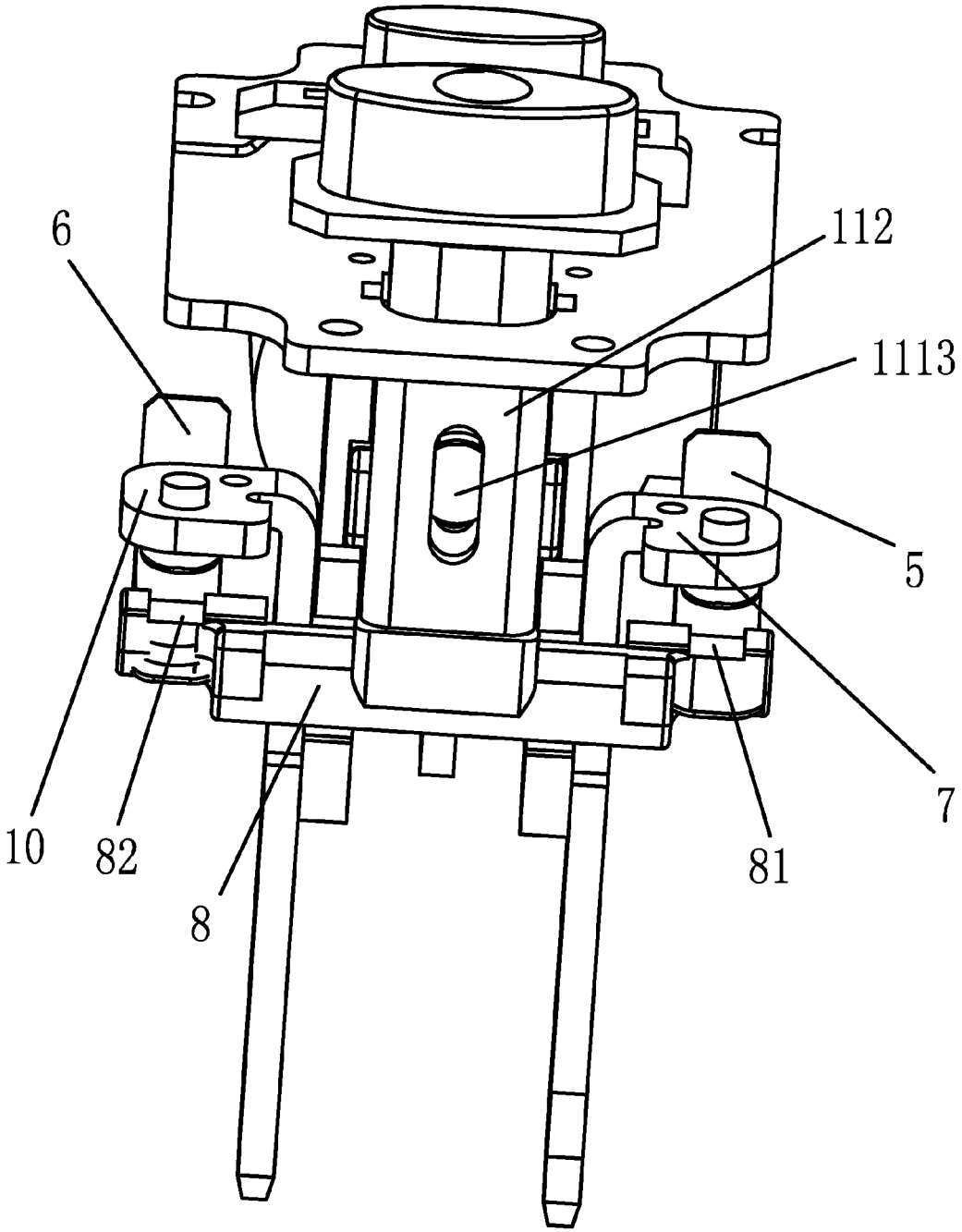
FIG. 2 is a first stereogram of a plug after removing a shell and a mounting body in accordance with one embodiment of the invention.
Figure 3:
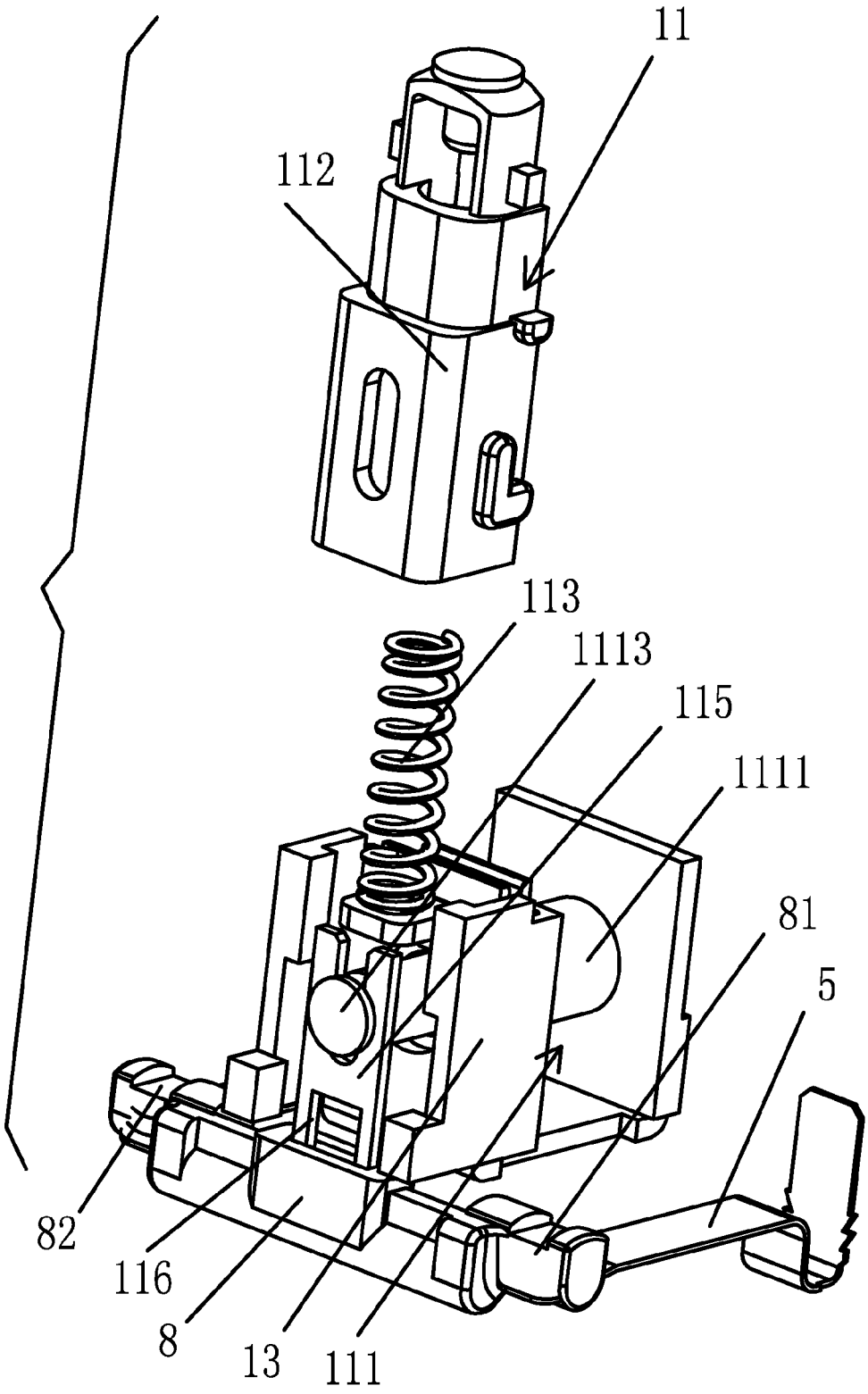
FIG. 3 is a first exploded view of a plug after removing a shell and a mounting body in accordance with one embodiment of the invention.
Figure 4:
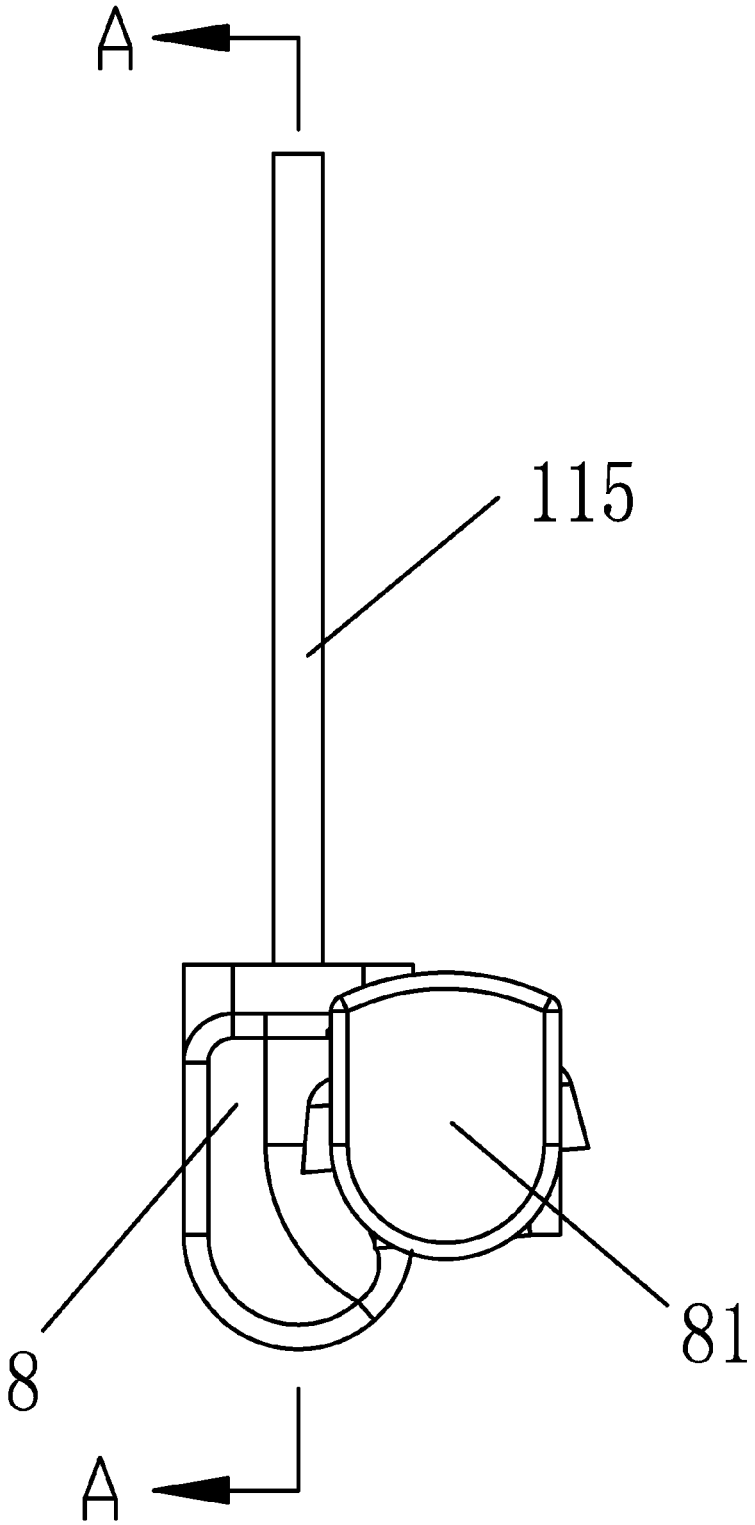
FIG. 4 is a diagram of a transverse block fitted with a pull block in accordance with one embodiment of the invention.
Figure 5:
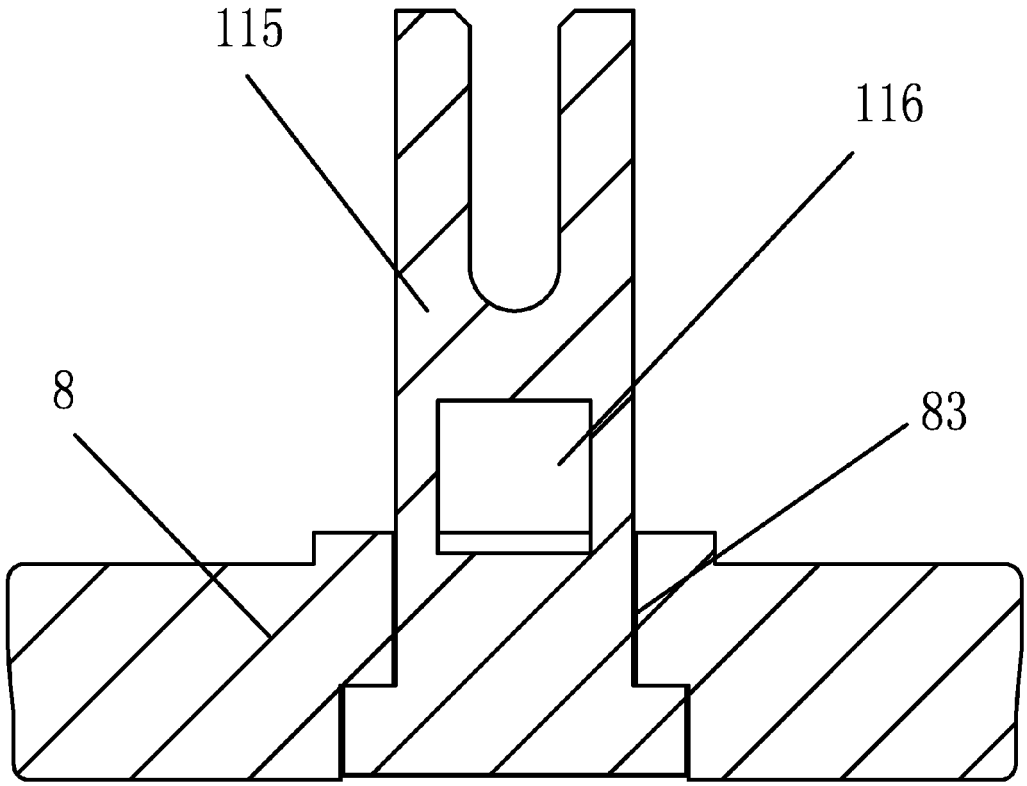
FIG. 5 is a sectional view taken from line A-A of FIG. 4 in accordance with one embodiment of the invention.
Figure 6:
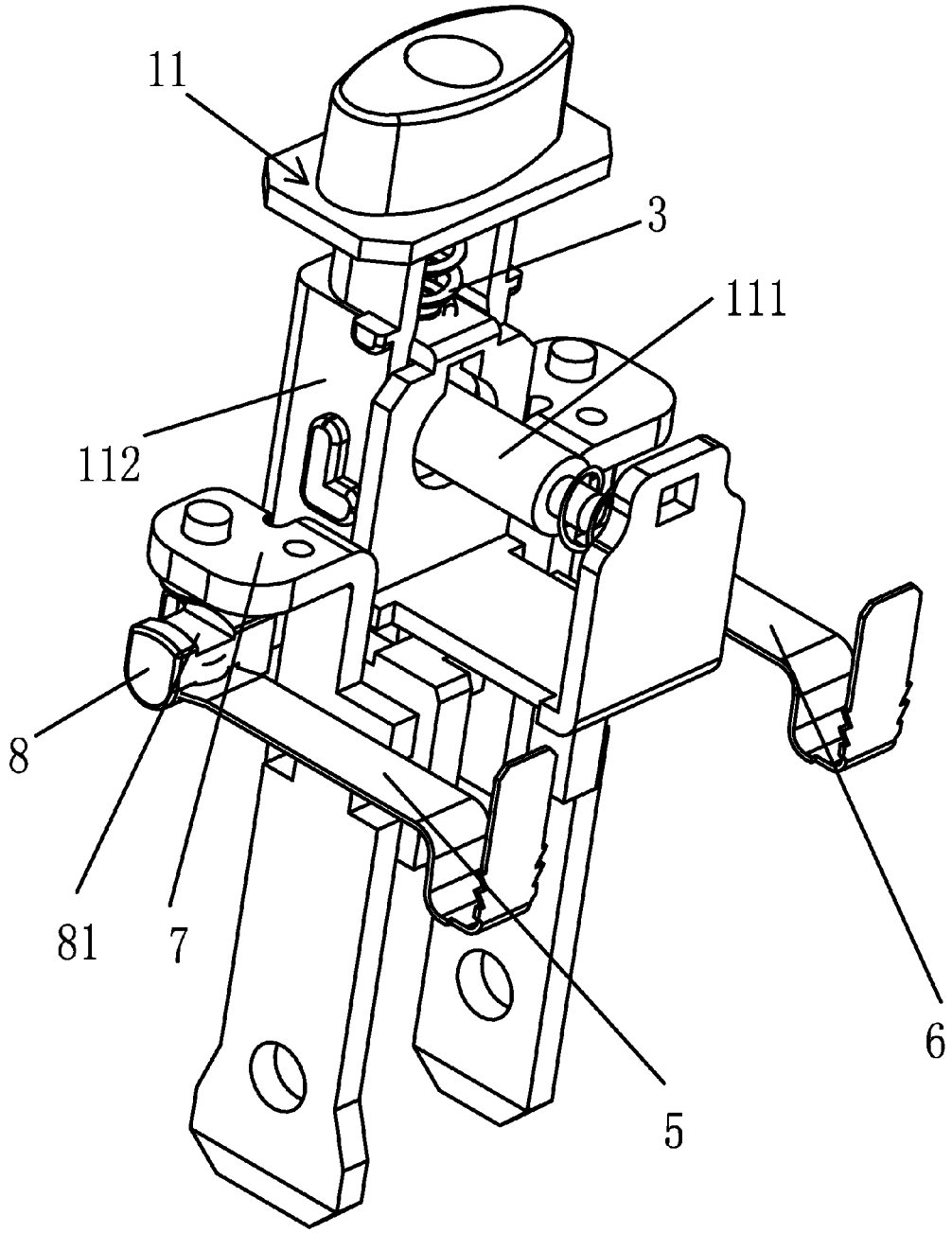
FIG. 6 is a second stereogram of a plug after removing a shell and a mounting body in accordance with one embodiment of the invention.
Figure 7:
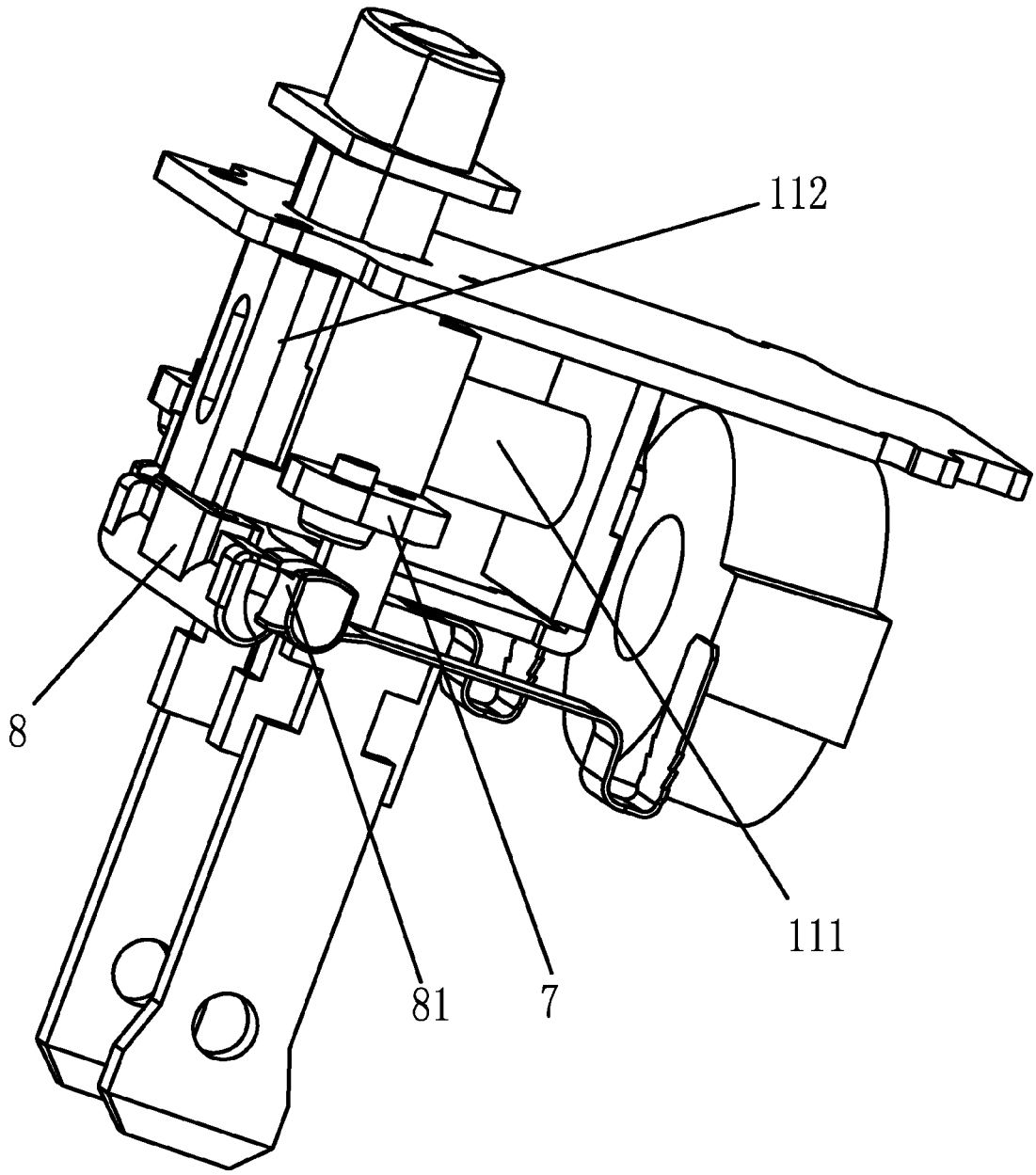
FIG. 7 is a third stereogram of a plug after removing a shell and a mounting body in accordance with one embodiment of the invention.
Figure 8:
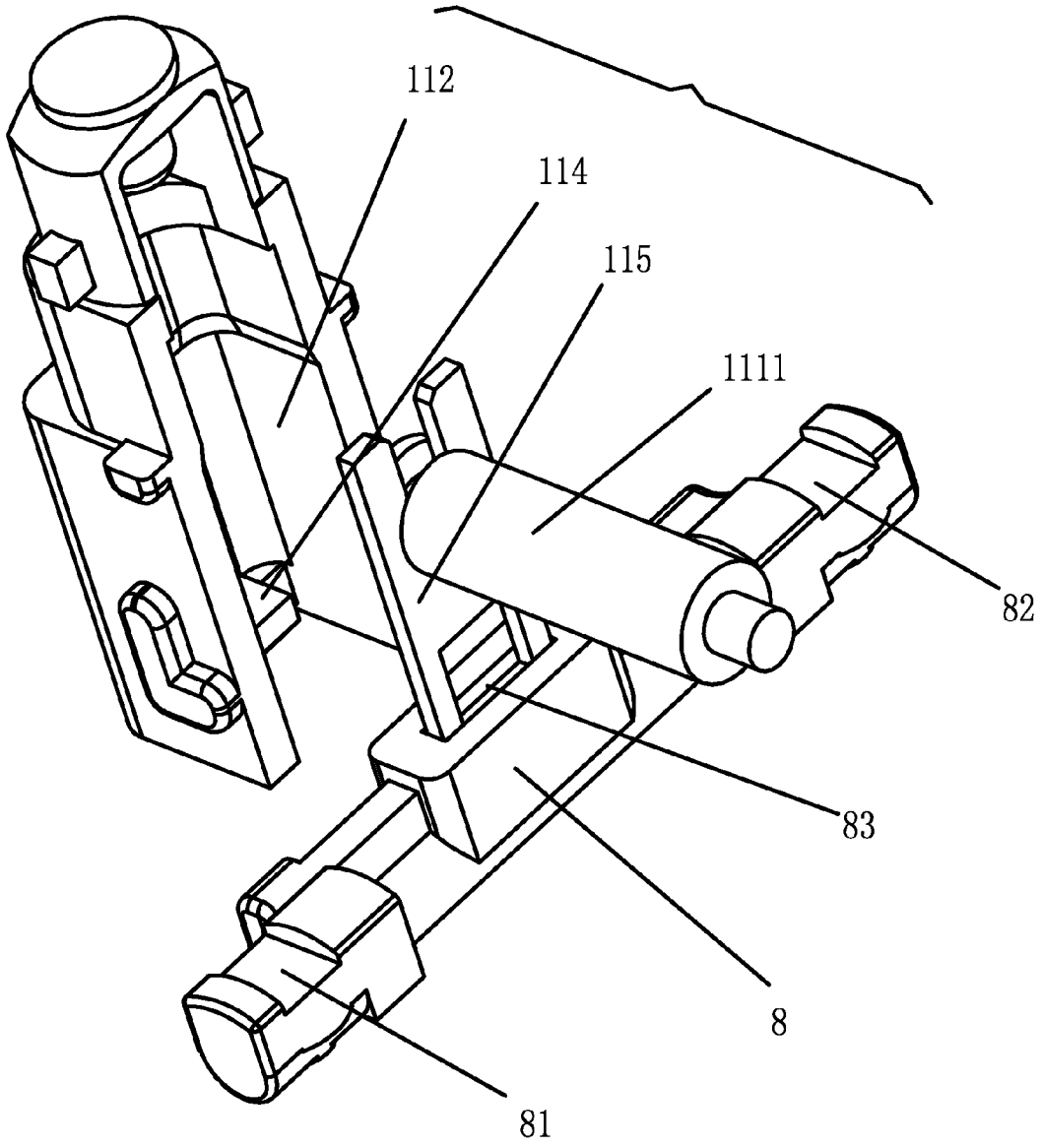
FIG. 8 is a second exploded view of a plug after removing a shell and a mounting body in accordance with one embodiment of the invention.
Figure 9:
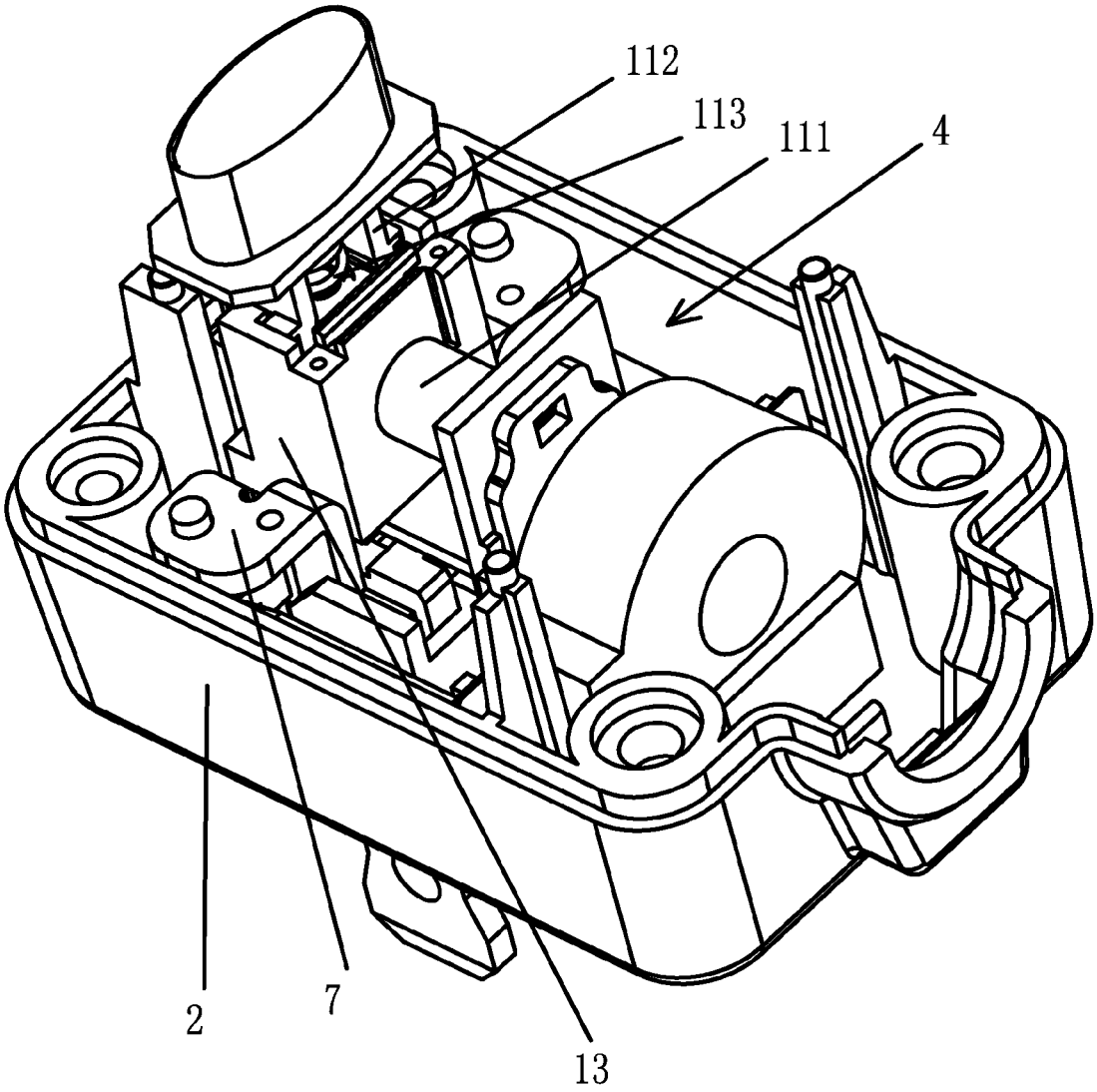
FIG. 9 is a stereogram of a plug after removing an upper cover in accordance with one embodiment of the invention.
Figure 10:
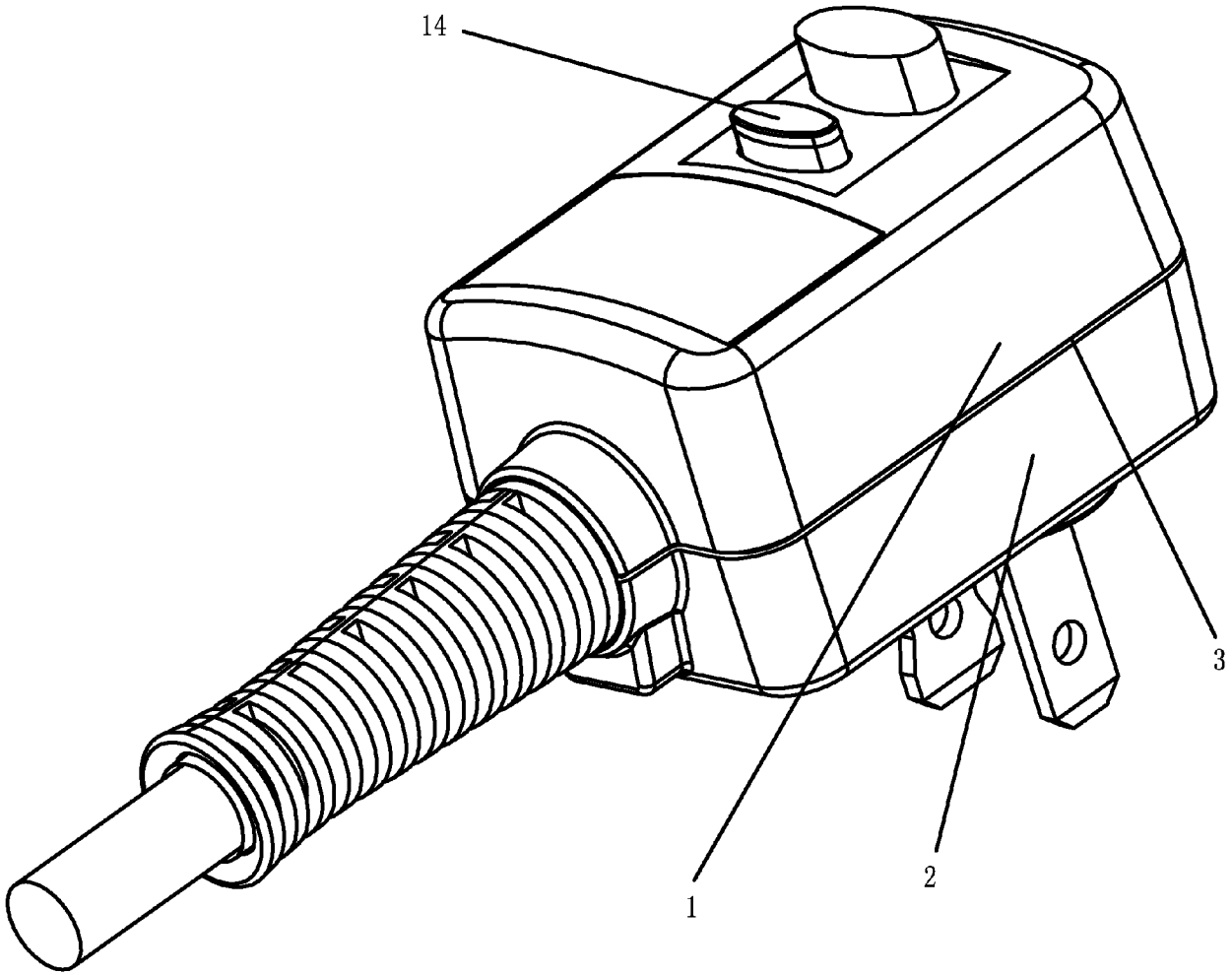
FIG. 10 is a stereogram of a plug in accordance with one embodiment of the invention.

As shown in FIGS. 1-10, a plug comprises a shell 3, and a mounting body 4 inside the shell 3. The mounting body 4 is provided with a first movable contact spring 5 and a second movable contact spring 6. A transverse block 8 is disposed above the first movable contact spring 5 and the second movable contact spring 6.

The transverse block 8 comprises a phase terminal 81 and a zero terminal 82 in electric connection with the first movable contact spring 5 and the second movable contact spring 6, respectively. The mounting body 4 is provided with a phase contact 7 and a zero contact 10 in electric connection with an external power supply. The phase terminal 81 and the zero terminal 82 are disconnected from the phase contact 7 and the zero contact 10 under elastic forces of the first movable contact spring 5 and the second movable contact spring 6, respectively. Thus, the plug is disconnected and the safety is improved.

The mounting body 4 is provided with a button assembly 11. Due to the drive of the button assembly 11, the phase contact 7 and the zero contact 10 are pressed by the phase terminal 81 and the zero terminal 82, respectively. Supposing that a force is applied to press the button assembly 11, once the force is released, the phase contact 7 and the zero contact 10 are pressed by the phase terminal 81 and the zero terminal 82, respectively. Thus, the connection between the plug and the power supply is achieved.

Specifically, the button assembly 11 comprises an electric magnet 111 disposed on the mounting body 4 and a sliding part 112 having a cavity. The sliding part 112 is capable of moving upwards and downwards. The cavity of the sliding part 112 is provided with a reset spring 113. An upper end of the reset spring 113 contacts with an inner top surface of the sliding part 112, and a lower end of the reset spring 113 presses on the mounting body 4. The sliding part 112 is pushed upwards due to the elastic force of the reset spring 113.

A hook 114 is disposed in a lower part of the cavity of the sliding part 112. The transverse block 8 is connected with a pull block 115. An upper part of the pull block 115 is connected with the electric magnet 111. Thus, the pull block 115 is movable due to the drive of the electric magnet 111. A limiting hole 116 is disposed in a center of the pull block 115, and the hook 114 can be limited by the limiting hole 116.

The shell 3 comprises an upper cover 1 and a lower cover 2. A reset button hole is disposed on the upper cover 1 for receiving a button cap of the button assembly 11. The phase contact 7 and the zero contact 10 are fixed on the lower cover 2, and the first movable contact spring 5 and the second movable contact spring 6 are disposed on the lower cover 2.

The transverse block 8 is provided with a through hole 83 in the middle. The pull block 115 employs a shape of an inverted T. The upper part of the pull block 115 is received by the through hole 83, and the upper part of the pull block 115 is connected with the electric magnet 111 after protruding from the through hole 83.

The electric magnet 111 comprises a sleeve 1111, a moving armature 1113, and a winding. A spring is disposed inside the sleeve 1111. The moving armature 1113 is disposed inside the sleeve 1111. When the winding is energized, the moving armature 1113 is attracted inwards, and the spring is pressed against an inner side of the sleeve 1111.

The mounting body 4 is further provided with a jacket 13. A guiding slot is disposed on the jacket 13, and the sliding part 112 is disposed on the guiding slot and is movable along the guiding slot.

The upper cover 1 is further provided with a test button 14 for energizing the electric magnet 111 to disconnect the plug.

To supply power to the plug, an external force is applied to press the sliding part 112, for example, press the sliding part 112 by a finger. When the sliding part 112 is pressed down to a certain degree, the hook 114 of the sliding part 112 is pushed into and limited by the limiting hole 116. Then, the external force is released, the sliding part 112 is pushed upwards due to the elastic force of the reset spring 113, and the sliding part 112 in turn drives the transverse block 8 upwards. Thus, the phase contact 7 and the zero contact 10 are contacted with the phase terminal 81 and the zero terminal 82, respectively, and the electric connection between the plug and the external power supply is achieved.

To disconnect the plug from the power supply, an external force is applied to press the test button 14, for example, using a finger to press the test button 14, and thus the electric magnet 111 is energized and move, that is, the moving armature 1113 is attracted inwards when the winding is energized. At the same time, the pull block 115 is moved driven by the movement of the moving armature 1113. Subsequently, the hook 114 of the sliding part 112 departs from the limiting hole 116 of the pull block 115. After that, the sliding part 112 is pushed upwards due to the elastic force of the reset spring 113, and the phase terminal 81 and the zero terminal 82 are disconnected from the phase contact 7 and the zero contact 10 under elastic forces of the first movable contact spring 5 and the second movable contact spring 6, respectively. Thus, the plug is disconnected and the safety is improved.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electric plug, comprising:

a) a shell (3);

b) a mounting body (4) disposed inside the shell (3), the mounting body (4) comprising a first movable contact spring (5) and a second movable contact spring (6), and a phase contact (7) and a zero contact (10) in electric connection with an external power supply;

c) a transverse block (8) disposed above the first movable contact spring (5) and the second movable contact spring (6) and comprising a phase terminal (81) and a zero terminal (82) in electric connection with the first movable contact spring (5) and the second movable contact spring (6), respectively; and d) a button assembly (11) disposed in the mounting body (4) for pressing the phase contact (7) and the zero contact (10) on the phase terminal (81) and the zero terminal (82);

wherein the phase terminal (81) and the zero terminal (82) are disconnected from the phase contact (7) and the zero contact (10) under elastic forces of the first movable contact spring (5) and the second movable contact spring (6), respectively;

the button assembly (11) comprises an electric magnet (111) disposed in the mounting body (4) and a sliding part (112) comprising a cavity, the sliding part (112) is capable of moving upwards and downwards, and the cavity is provided with a reset spring (113);

a lower part of the cavity comprises a hook (114);

the transverse block (8) is connected with a pull block (115); and an upper part of the pull block (115) is connected with the electric magnet (111), and a center of the pull block (115) comprises a limiting hole (116) for accommodating the hook (114).

2. The plug of claim 1, wherein the shell (3) comprises an upper cover (1) and a lower cover (2);

a reset button hole is disposed on the upper cover (1) for receiving a button cap of the button assembly (11);

the phase contact (7) and the zero contact (10) are fixed on the lower cover (2); and the first movable contact spring (5) and the second movable contact spring (6) are disposed on the lower cover (2).

3. The plug of claim 1, wherein the transverse block (8) is provided with a through hole (83) in the middle;

the pull block (115) is inverted T-shaped;

a lower part of the pull block (115) is received by the through hole (83); and the upper part of the pull block (115) is connected with the electric magnet (111) after protruding from the through hole (83).

4. The plug of claim 2, wherein the transverse block (8) is provided with a through hole (83) in the middle;

the pull block (115) is inverted T-shaped;

a lower part of the pull block (115) is received by the through hole (83); and the upper part of the pull block (115) is connected with the electric magnet (111) after protruding from the through hole (83).

5. The plug of claim 3, wherein the electric magnet (111) comprises a sleeve (1111), a moving armature (1113), and a winding;

a spring is disposed inside the sleeve (1111);

the moving armature (1113) is disposed inside the sleeve (1111); and when the winding is energized, the moving armature (1113) is attracted inwards, and the spring is pressed against an inner side of the sleeve (1111).

6. The plug of claim 4, wherein the electric magnet (111) comprises a sleeve (1111), a moving armature (1113), and a winding;

a spring is disposed inside the sleeve (1111);

the moving armature (1113) is disposed inside the sleeve (1111); and when the winding is energized, the moving armature (1113) is attracted inwards, and the spring is pressed against an inner side of the sleeve (1111).

7. The plug of claim 3, wherein the mounting body (4) is further provided with a jacket (13) comprising a guiding slot, and the sliding part (112) is disposed on the guiding slot (131) and is movable along the guiding slot.

8. The plug of claim 4, wherein the mounting body (4) is further provided with a jacket (13) comprising a guiding slot, and the sliding part (112) is disposed on the guiding slot (131) and is movable along the guiding slot.

9. The plug of claim 2, wherein the upper cover (1) is further provided with a test button (14) for energizing the electric magnet (111) to disconnect the plug.

10. The plug of claim 3, wherein an upper end of the reset spring (113) contacts with an inner top surface of the sliding part (112), and a lower end of the reset spring (113) presses on the mounting body (4).

11. The plug of claim 4, wherein an upper end of the reset spring (113) contacts with an inner top surface of the sliding part (112), and a lower end of the reset spring (113) presses on the mounting body (4).

* * * * *